US007267069B2

(12) United States Patent
Mizutani

(10) Patent No.: US 7,267,069 B2
(45) Date of Patent: Sep. 11, 2007

(54) STEERING CONTROL SYSTEM FOR BOAT

(75) Inventor: Makoto Mizutani, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/384,616

(22) Filed: Mar. 20, 2006

(65) Prior Publication Data

US 2006/0217012 A1 Sep. 28, 2006

(30) Foreign Application Priority Data

Mar. 18, 2005 (JP) ..... 2005-080118
May 19, 2005 (JP) ..... 2005-146272

(51) Int. Cl.
*B63H 25/00* (2006.01)

(52) U.S. Cl. ..... 114/144 R; 114/144 RE; 440/1

(58) Field of Classification Search ..... 114/144 R, 114/144 RE; 440/1
See application file for complete search history.

(56) References Cited

U.S. PATENT DOCUMENTS 2,215,003 A 9/1940 Johnson
2,224,357 A 12/1940 Pecker
3,084,657 A 4/1963 Kiekhaefer
3,233,691 A 2/1966 De Biasi
3,310,021 A 3/1967 Shimanckas
3,349,744 A 10/1967 Mercier et al.
4,120,258 A 10/1978 Spurgin
4,220,111 A 9/1980 Krautkremer et al.
4,500,298 A * 2/1985 Hall et al. ..... 440/62
4,519,335 A 5/1985 Krautkremer et al.
4,787,867 A 11/1988 Takeuchi et al.
4,872,857 A 10/1989 Newman et al.
4,908,766 A 3/1990 Takeuchi
4,909,765 A 3/1990 Riske et al.
5,029,547 A 7/1991 Novey
5,031,562 A 7/1991 Nakase et al.
5,231,888 A 8/1993 Katahira
5,235,927 A 8/1993 Singh et al.
5,244,426 A 9/1993 Miyashita et al.

(Continued)

FOREIGN PATENT DOCUMENTS

JP 62-166193 7/1987

(Continued)

OTHER PUBLICATIONS

U.S. Appl. No. 11/354,491 filed Feb. 15, 2006. Title: Steering Control System for Boat.

(Continued)

*Primary Examiner*—Stephen Avila
(74) *Attorney, Agent, or Firm*—Knobbe, Martens, Olson & Bear, LLP

(57) ABSTRACT

A load variation amount can be derived from an output of a load sensor for detecting an external force acting on a watercraft. A computation can be performed whether or not the load variation amount is larger than a reference value calculated based on the load sensor output, a running state, and a navigation velocity. The width and the magnitude of a pulse are determined based on the load sensor output, the running state, and the navigation velocity, and the pulse is applied to a steering as reaction torque.

13 Claims, 7 Drawing Sheets

U.S. PATENT DOCUMENTS

| | | | | |
|---|---|---|---|---|
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 * | 6/2002 | Rheault et al. | 114/144 R |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,892,661 | B2 | 5/2005 | Kishi et al. | |
| 6,892,662 | B2 | 5/2005 | Watanabe et al. | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0170712 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 04-038297 | 2/1992 |
| JP | B-HEI 6-33077 | 5/1994 |
| JP | 2739208 B2 | 1/1998 |
| JP | 10/2226346 | 8/1998 |
| JP | A-HEI 10-310074 | 11/1998 |
| JP | 2959044 B2 | 7/1999 |
| JP | 2000-318691 | 11/2000 |
| JP | 2003-313398 | 11/2000 |
| JP | 3232032 | 9/2001 |
| JP | A-2002-331948 | 11/2002 |
| JP | A-204-155282 | 6/2004 |

OTHER PUBLICATIONS

U.S. Appl. No. 11/089,929 filed Mar. 25, 2005. Now published as US 2005-0215131A1 (submitted herewith). Title: Steering System of Outboard Motor.

U.S. Appl. No. 11/075,131 filed Mar. 8, 2005. Now issued as US 7,063,030 (submitted herewith). Title: Electric Steering Apparatus for Watercraft.

U.S. Appl. No. 11/075,129 filed Mar. 8, 2005. Now published as US 2005-0199169A1 (submitted herewith). Title: Steering Assist System for Boat.

U.S. Appl. No. 11/074,805 filed Mar. 8, 2005. Now published as US 2005-0199167A1 (submitted herewith). Title: Steering System for Boat.

U.S. Appl. No. 11/155,757 filed Jun. 17, 2005. Now published as US 2005-0282447A1 (submitted herewith). Title: Steering Device for Small Watercraft).

U.S. Appl. No. 11/047,098 filed Jan. 31, 2005. Now published as US 2005-0170712A1 (submitted herewith). Title: Method and System for Steering Watercraft.

U.S. Appl. No. 11/047,123 filed Jan. 31, 2005. Now published as US 2005-0170713A1 (submitted herewith). Title: Method and System for Steering Watercraft.

Co-Pending U.S. Appl. No. 11/588,060, filed Oct. 25, 2006. (A copy of the application as filed is submitted herewith.) Title: Control Unit for Multiple Installation of Propulsion Units. Invenor: Mizutani.

Co-Pending U.S. Appl. No. 11/515,600, filed Sep. 5, 2006. ( A copy of the application as filed is submitted herewith.) Title: Steering System for a Small Boat. Inventor: Muzutani.

Co-Pending U.S. Appl. No. 11/516,151, filed Sep. 5, 2006. (A copy of the application as filed is submitted herewith.) Title: Steering Method and Steering System for Boat. Inventor: Mizutani.

Co-Pending U.S. Appl. No. 11/593,393, filed Nov. 6, 2006, (A copy of the application as filed is submitted herewith.) Title: Electric Tryp Sterring device for Outboard Motors. Inventor: Mizutani.

Co-Pending U.S. Appl. No. 11/507,399, filed Aug. 21, 2006. Now published as US2006-0079139A1. (A copy of the publication is submitted herewith.) Title: Action Control Device for Small Boat. Inventor: Mizutani.

Co-Pending U.S. Appl. No. 11/029,667, filed Jan. 5, 2005. Now published as US2006-0019558A1. ( A copy of the publication is submitted herewith.) Title: Steering System for Outboard Drive. Inventor: Mizutani et al.

* cited by examiner

STEERING CONTROL SYSTEM FOR BOAT

PRIORITY INFORMATION

The present application is based on and claims priority under 35 U.S.C. § 119(a–d) to Japanese Patent Application No. 2005-080118, filed on Mar. 18, 2005 and Japanese Patent Application No. 2005-146272, filed on May 19, 2005 the entire contents of both of which is expressly incorporated by reference herein.

BACKGROUND OF THE INVENTION

1. Field of the Invention

The present inventions relate to steering control systems for boats including an electric steering drive system.

2. Description of the Related Art

A conventional electric steering control system for an outboard motor is described in Japanese Patent Document JP-B-2959044. In the device, the rotation or pivoting of a steering wheel or handle is detected by a sensor. The sensor sends a signal to a controller. Using this signal, the controller drives an electric motor which in turn, changes the steering angle of the outboard motor to thereby steer the boat in accordance with the movement of the steering wheel or handle. The controller is configured to change the steering angle of the outboard motor by a predetermined amount based on the detection of predetermined amounts of rotation or pivoting of the steering wheel or handle.

These types of electric steering systems have become more popular recently. One reason is that these types of systems do not have a direct mechanical connection between the steering wheel or handle and the steering member. Thus, the movement or feeling of the steering wheel or handle is light, regardless of the speed of the watercraft. As such, it is easy for an operator to turn the steering wheel or handle at any operating speed.

During normal operation, however, changes in external forces applied to the boat, such as by waves and winds, are not transmitted to the steering wheel. Thus, drivers of such watercraft are not provided with the tactile signals corresponding to the changes in external forces that are normally provided to drivers of watercraft with conventional direct drive steering systems.

Other systems, such as that disclosed in Japanese Patent Document 2004-065689, have been proposed in which a sensor is provided for detecting the external forces applied to the boat. A reaction torque motor is used to apply torque to the steering device in response to the detected external force and control means are provided for converting the external force detected by the sensor to a value for torque, so that the reaction torque motor applies torque dependent on the external force to the steering device. With such a device, the operator can detect changes in the external force through the feeling of the forces applied to the steering wheel.

SUMMARY OF THE INVENTION

An aspect of at least one of the inventions disclosed herein includes the realization that steering systems that apply reaction forces to the steering wheels, such as those systems disclosed in Japanese Patent Document 2004-065689, consume an excessive amount of power. For example, when an external force is detected by such a steering system, and a reaction force is applied to the steering wheel, to return the boat to the operator's desired course, the operator must apply torque to the steering device in the opposite direction to that applied by the reaction torque motor. This results in a problem that the labor of the operator and the power consumption of the reaction torque motor can be excessive.

Another problem arises when the operator is steering against a torque applied by the reaction torque motor for an extended period of time, for example when traveling in a straight line in a strong cross-wind, a significant amount of power is continuously consumed, thus reducing energy efficiency of the boat.

Thus, in accordance with an embodiment, a steering control system for a boat provided externally of its hull with a steering device rotatable by an electric actuator to change a navigation direction can be provided. The steering control system can include a steering system electrically connected to the steering device via the electric actuator to operate the steering device. External force detection means can be provided for detecting external force applied to the steering device. A reaction torque motor can be provided for applying torque to the steering system. Additionally, control means can be provided which monitors a detection state of the external force detection means, and causes the reaction torque motor to apply pulsed torque when the external force detection means detects that an amount of variation in the external force is a predetermined value or larger.

In accordance with another embodiment, a steering control system for a boat having a steering input device disposed in an operator's area and a steering device arranged to contact a body of water in which the boat operates to generate forces for turning the boat can be provided. The control system can comprise an electric actuator configured to move the steering device through a range of movement corresponding to different moving directions of the boat. An external force detector can be configured to detect an external force applied to the steering device. A reaction torque motor can be configured to apply a torque to the steering input device. A controller can be configured to monitor a detection state of the external force detector, and to control the reaction torque motor to apply pulsed torque to the steering input deice when the external force detector detects an amount of variation in the external force is a predetermined value or larger.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
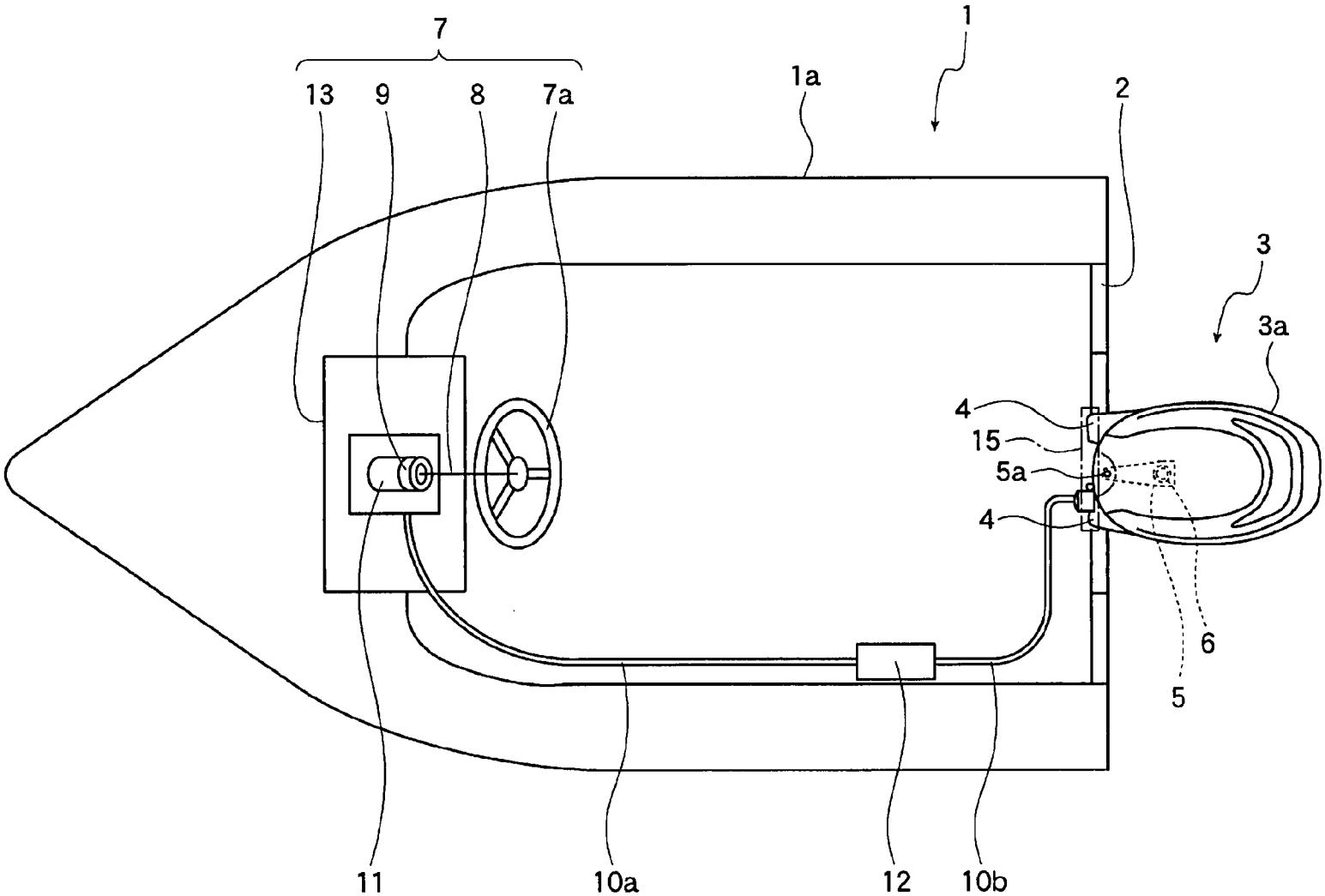
FIG. 1 is a schematic plan view of a boat using a steering control system according to an embodiment.

FIG. 1 is a schematic plan view of a boat using a steering control system for a small boat 1 according to an embodiment. The embodiments disclosed herein are described in the context of a small watercraft having at least one outboard motor because the embodiments disclosed herein have particular utility in this context. However, the embodiments and inventions herein can also be applied to other boats having other types of propulsion units as well as other types of vehicles.

As used herein, the terms "front," "rear," "left," "right," "up" and "down," correspond to the direction assumed by a driver of the watercraft.

Reference numeral 1 denotes a small boat which can be any type of small boat. The boat 1 can include a hull 1*a* and an outboard motor 3 for generating thrust for the boat 1 through a propeller 14 (see FIG. 2) as well as changing the moving direction of the boat 1.

Figure 2:
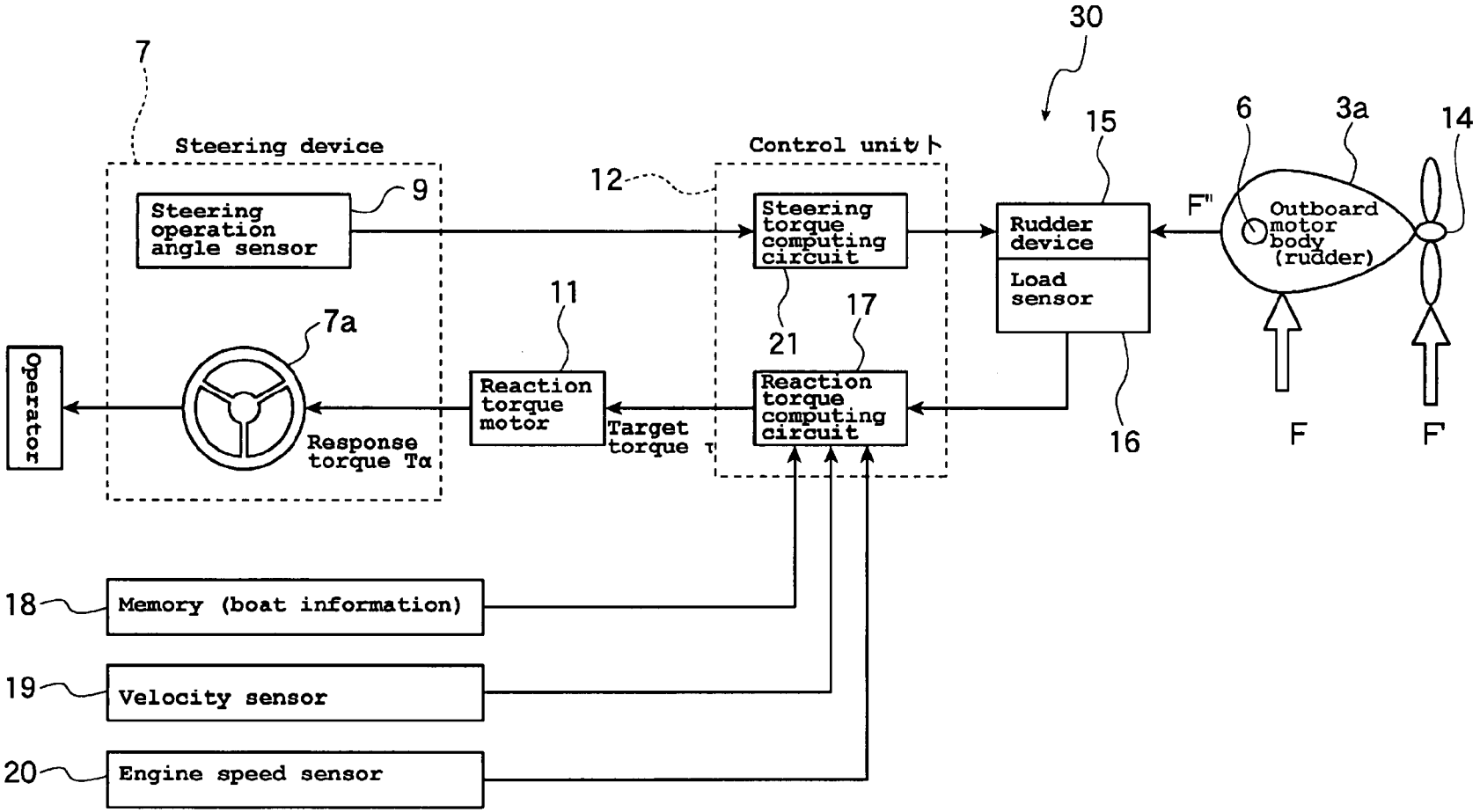
FIG. 2 is a control block diagram of the steering control system.

An outboard motor body 3*a* of the outboard motor 3 can be attached to a transom plate 2 at the rear end (at the right end in the drawing) of the hull 1*a* via a clamp bracket 4, and can house therein an engine (not shown) for rotating the propeller 14 (FIG. 2). The outboard motor body 3*a* can be journaled by a swivel shaft 6 provided generally in the center.

An end of an elongated plate-shaped steering bracket 5 can be secured to the swivel shaft 6, and the other end 5*a* of the steering bracket 5 can be coupled to a steering or "rudder" device 15. The rudder device 15 can include, for example, an electric actuator (not shown) such as a DD (direct drive) electric motor, and a threaded shaft (not shown) provided parallel to the transom plate 2, however, other configurations can also be used.

When the electric actuator (not shown) is driven, the other end 5*a* of the steering bracket 5 is moved in parallel along the transom plate 2 (that is, in the left and right direction with respect to the moving direction of the boat 1). The movement of the steering bracket 5 can be transmitted to the outboard motor body 3*a*, which then rotates about the swivel shaft 6 to change the direction of the outboard motor 3.

A steering device 7, which can define a part of the steering system, can be provided in the hull 1*a* forward of an operator's seat. As such, the operator can input steering commands into the steering device 7.

The "steering system" as used herein refers to various mechanisms used for steering purposes, and can include a steering shaft 8, a steering wheel 7*a*, the steering device 7, and the like. However, other configurations and components can also be used.

The distal end of the steering shaft 8 can be joined to the center of the steering wheel 7*a* of the steering device 7, and the proximal end of the steering shaft 8 can be inserted in and rotatably supported by a steering control section 13. A steering operation angle sensor 9 and a reaction torque motor 11 can be provided around the steering shaft 8 in the steering control section 13. The steering control section 13 can be connected via a signal cable 10*a* to a control unit 12, which in turn can be connected to the rudder device 15 via a signal cable 10*b*.

FIG. 2 is a control block diagram of a steering control system 30 for a boat of this embodiment. As shown in FIG. 2, the steering control system 30 for a boat can include the steering device 7 having the steering wheel 7*a* and the steering operation angle sensor 9, the reaction torque motor 11, the control unit 12 having a steering torque computing circuit 21 and a reaction torque computing circuit 17, a load sensor 16 provided in the rudder device 15, a memory 18, a velocity sensor 19 as the velocity detection means, and an engine speed sensor 20 as the running state detection means. However other configurations and components can also be used. In some embodiments, the steering operation angle sensor 9 of the steering device 7 can be configured to detect the rotation angle of the steering wheel 7*a* from the rotation angle of the steering shaft 8 (FIG. 1).

The control unit 12 can be a processing unit having a CPU (central processing unit), a main storage device, an auxiliary storage device, and the like, and can be configured to control operation of the entire steering control system 30 based on one or more programs implemented therein. However, the control unit 12 can also be in the form of a hard-wired control circuit, a plurality of CPUs and memory devices, or any other device that can be configured to perform the functions described herein.

The functions of the steering torque computing circuit 21 can be performed by the CPU of the control unit 12. For example, the CPU can be configured to calculate the rotation angle of the steering wheel 7*a* from the angle signal detected by the steering operation angle sensor 9. On detecting the rotation angle of the steering wheel 7*a*, the steering torque computing circuit 21 can compute steering torque for the rudder device 15 based on the detection signal, and can supply a signal to the electric actuator motor (not shown) of the rudder device 15 to change the direction of the outboard motor body 3*a*.

The load sensor 16 can be configured to detect external forces acting on the outboard motor body 3*a*, and thus can function as a detection means for detecting external force which acts on the outboard motor body 3*a* due to such as winds and waves N (see FIG. 5) as well as external forces which act as resistive forces against rotation of the outboard motor body 3*a* (hereinafter simply referred to as "external force" in the entire document). In some embodiments, the load sensor 16 can be configured to detect torques which act on the swivel shaft 6 as a steering shaft for the rudder device 15. The load sensor 16 can be a shaft torque sensor which directly detects shaft torque, or may be detection means such as a distortion sensor which performs measurement on part of the steering control system 30 to which the shaft torque can be transmitted.

During operation, as shown in FIG. 2, rotation torque Tr detected by the load sensor 16 corresponds to resultant force F" of load torque Tβ corresponding to external force F received by the outboard motor body 3*a* from water flow, and torque Tp corresponding to force F' due to paddle-rudder effect and the like generated by rotation of the propeller 14 provided at the outboard motor body 3*a*. Thus, the load torque Tβ can be calculated by subtracting the torque Tp corresponding to paddle-rudder effect and the like from the rotation torque Tr, by the reaction torque computing circuit 17 (see the description of S4 of FIG. 3 set forth below).

The velocity sensor 19 can be configured to detect the velocity of the boat 1 and can send a detection signal to the reaction torque computing circuit 17.

The engine speed sensor 20 can be configured to detect the engine speed of the engine within the outboard motor body 3*a*, which is a useful indicator of the running state of the boat 1. Additionally, the engine speed sensor 20 can be configured to send the detection result to the reaction torque computing circuit 17.

The memory 18 can be any type of data storage device and thus can serve as a means for storing boat information used for calculating the magnitude of load torque Tβ to be applied to a rudder of the outboard motor body 3*a*, from the signal supplied to the reaction torque computing circuit 17. Such information can include, for example, but without limitation, the dimensions of the hull 1*a* (FIG. 1) and the outboard motor body 3*a*.

The functions of the reaction torque computing circuit 17 can be performed by the CPU of the control unit 12. For example, the reaction torque computing circuit 17 can be configured to calculate target torque τ, which can be a target value for torque to be applied to the steering wheel 7*a* by the reaction torque motor 11, based on, for example, the signals detected by the load sensor 16, the velocity sensor 19, and the engine speed sensor 20, and the information accumulated in the memory 18. However, other data can also be used.

During operation, in some embodiments, when an operator rotates the steering wheel 7*a* while the boat 1 (FIG. 1) is moving, the steering operation angle sensor 9 detects the rotation angle of the steering wheel 7*a* and sends a signal for the detected angle to the steering torque computing circuit 21 of the control unit 12. On receiving the signal for the detected rotation angle, the steering torque computing circuit 21 detects the steering torque applied to the steering wheel 7*a*, and then calculates a rotation amount for the electric actuator (not shown) of the rudder device 15 based on the steering torque and supplies a command signal for the rotation amount. The electric actuator (not shown) can be driven according to the command signal to change the direction of the outboard motor body 3*a*.

Meanwhile, when the load sensor 16 detects load variation ΔF by the external force F of a predetermined value or larger, the reaction torque computing circuit 17 supplies a signal for pulsed target torque τ to the reaction torque motor 11.

Figure 3:
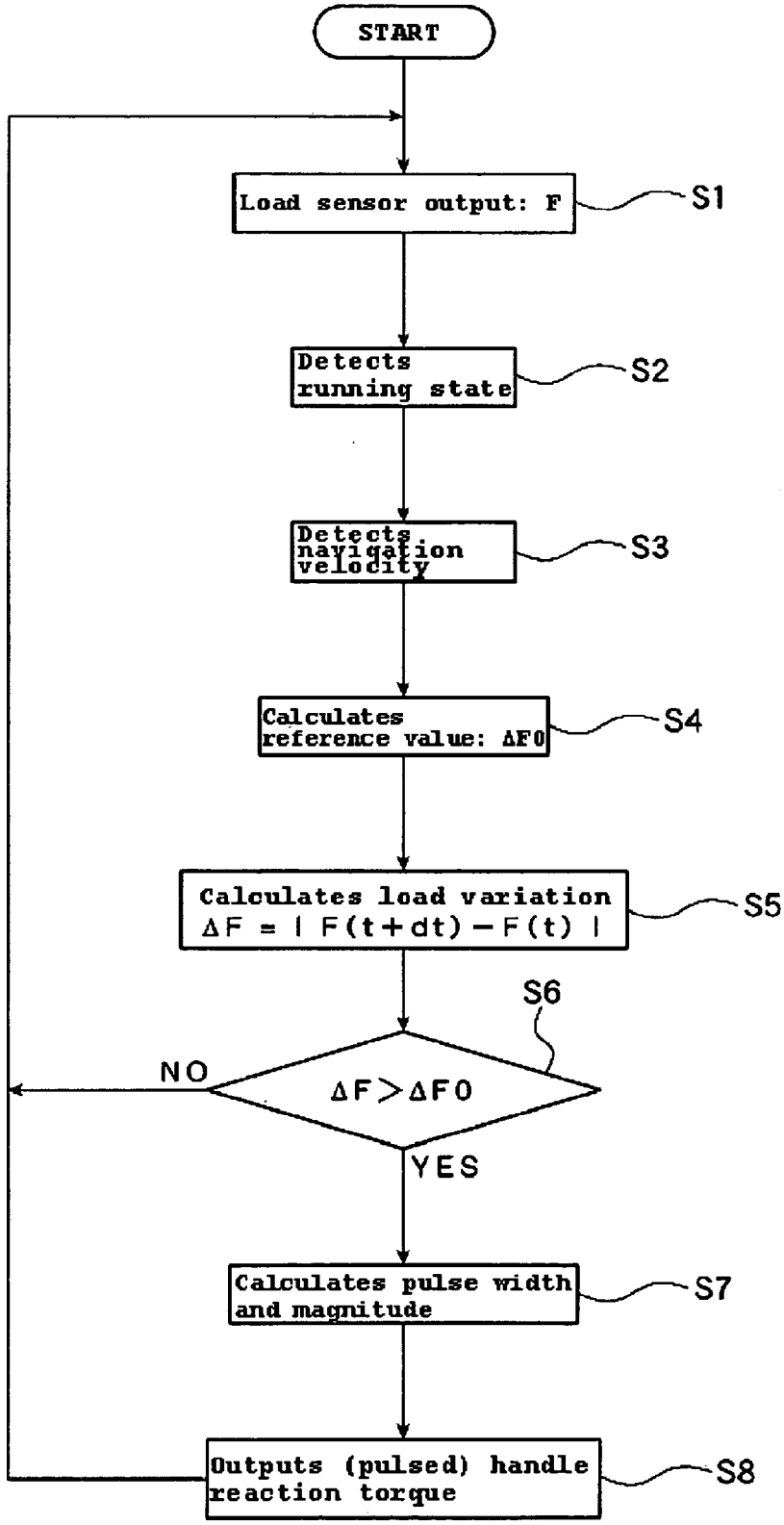
FIG. 3 is a flowchart of processes that can be executed by a reaction torque computing circuit when an outboard motor body receives an external force.

FIG. 3 is a flowchart of exemplary processes that can be executed by the reaction torque computing circuit 17 in some embodiments, when the outboard motor body 3*a* receives external force of a predetermined value or larger. Hereinafter, the procedure for applying response to the steering wheel 7*a* is described based on the flowchart of FIG. 3.

When the boat 1 receives an external force and the hull 1*a* turns (see FIG. 1), the angle of the outboard motor 3*a* relative to the hull 1*a* changes and hence the water pressures which act on the left and right sides of the outboard motor body 3*a* also change. The load sensor 16 detects external force applied to the rudder by the change in the water pressure, based on the load applied to a gear shaft (not shown) of the rudder device 15, and supplies a detection signal for the rotation torque Tr, which can be based on the external force, to the reaction torque computing circuit 17 of the control unit 12 (S1). This can be referred to as an external force acquisition process.

In the step S2, the reaction torque computing circuit 17 receives a signal for the engine speed detected by the engine speed sensor 20 and information stored in the memory 18 such as the trim angle and the size of the propeller 14 (S2). This can be referred to as a running state acquisition process. In step S3, the reaction torque computing circuit 17 can further receive a signal indicative of the velocity of the boat 1 detected by the velocity sensor 19. This can be referred to as a navigation velocity acquisition process.

In the step S4, the reaction torque computing circuit 17 can calculate torque Tp corresponding to the force F' based on the information stored in the memory 18, and then obtains load torque Tβ by subtracting the torque Tp corresponding to the force F' from the rotation torque Tr corresponding to the resultant force F". The reaction torque computing circuit 17 can further calculate a reference value ΔF0 using the obtained values for the load torque Tβ, the running state, the velocity information, and the like by a predetermined arithmetic expression. The reference value ΔF0 can be, for example, a minimum value for load variation by external force at which it is necessary to apply response torque Tα to the steering wheel 7*a*. By the use of the engine speed, in addition to the load torque Tβ, in the calculation of the reference value ΔF0, it can be possible to calculate an operation amount of the steering wheel 7*a* for the boat 1 to recover its navigation position which can be suitable for the navigation conditions.

In the step S5, the reaction torque computing circuit 17 can calculate a load variation amount ΔF by the external force F detected by the load sensor 16 based on the expression: $\Delta F=|F(t+dt)-F(t)|$. However, other calculations can also be used.

In the step S6, the reaction torque computing circuit 17 can determine whether or not the variation value ΔF is larger than the reference value ΔF0. This can be referred to as a comparison process. If the variation value ΔF is not larger than the reference value ΔF0 (NO), the process can returns to the step S1 and repeats.

If, however, in the step S6, the variation value ΔF is larger than the reference value ΔF0 (YES), the process can proceed to step S7.

In the step S7, the reaction torque computing circuit 17 can determine the width and the magnitude of a signal for output using the values for the load torque Tβ, the running state, and the navigation velocity and based on a predetermined arithmetic expression. This can be referred to as a determination process.

In the step S8, reaction torque computing circuit 17 can designate the duration and the magnitude of the target torque τ to output pulsed steering reaction torque. This can be referred to as a command process.

By using the running state of the boat 1 and the navigation velocity of the boat 1, in addition to the load torque Tβ, in the calculation of the target torque τ, it can be possible to accurately calculate the torque amount corresponding to the operation amount of the steering wheel 7*a* necessary for the boat 1 to recover its navigation position.

A signal for the target torque τ can be supplied to the reaction torque motor 11, which is driven based on the signal for the target torque τ to apply response torque Tα to the steering wheel 7*a*. The above procedure can be repeated until the variation value ΔF reaches the reference value ΔF0 or smaller ((NO) in S6).

The signal for the target torque τ output in step S8 can be a pulse signal, and hence the response torque Tα output based on the target torques τ can be also pulsed torque. The term "pulsed torque" herein refers to torque applied for a period shorter than that of the force F" applied to the outboard motor 3. For example, torque can be output for a minute with an electric motor energized for a minute, and as such can be considered this type of pulsed torque. However, other time periods can also be used and would also be considered pulsed torques.

Figure 6:
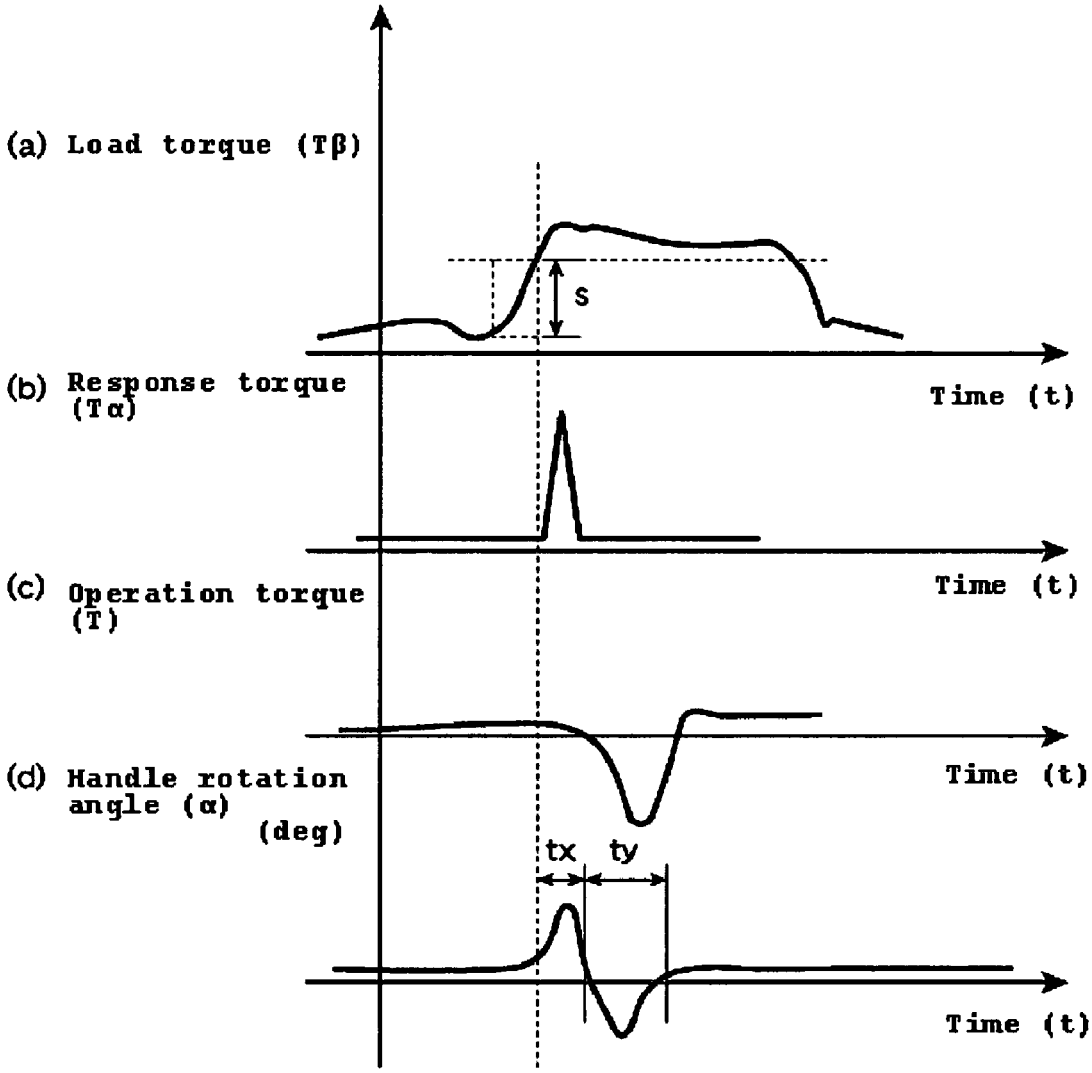
FIG. 6 includes several schematic timing diagrams showing exemplary relationships between the magnitude and the direction of external forces applied to the steering control system.

In some embodiments, the target torque τ can be represented by a triangular pulse or "saw-tooth" signal (see FIG. 6(*b*)), and hence the response torque Tα can be also pulsed torque similar to the pulse signal. The magnitude and the duration of the response torque Tα may be arbitrary as long as the operator can sense that external force has been applied to the boat 1, and thus the magnitude and the duration of the target torque τ may also be arbitrary as long as the resulting torque can accomplish the above purpose. However, in order not to increase the labor of the operator significantly but to reduce the power consumption of the reaction torque motor 11, the target torque τ and the response torque Tα are preferably not excessively large.

Figure 4:
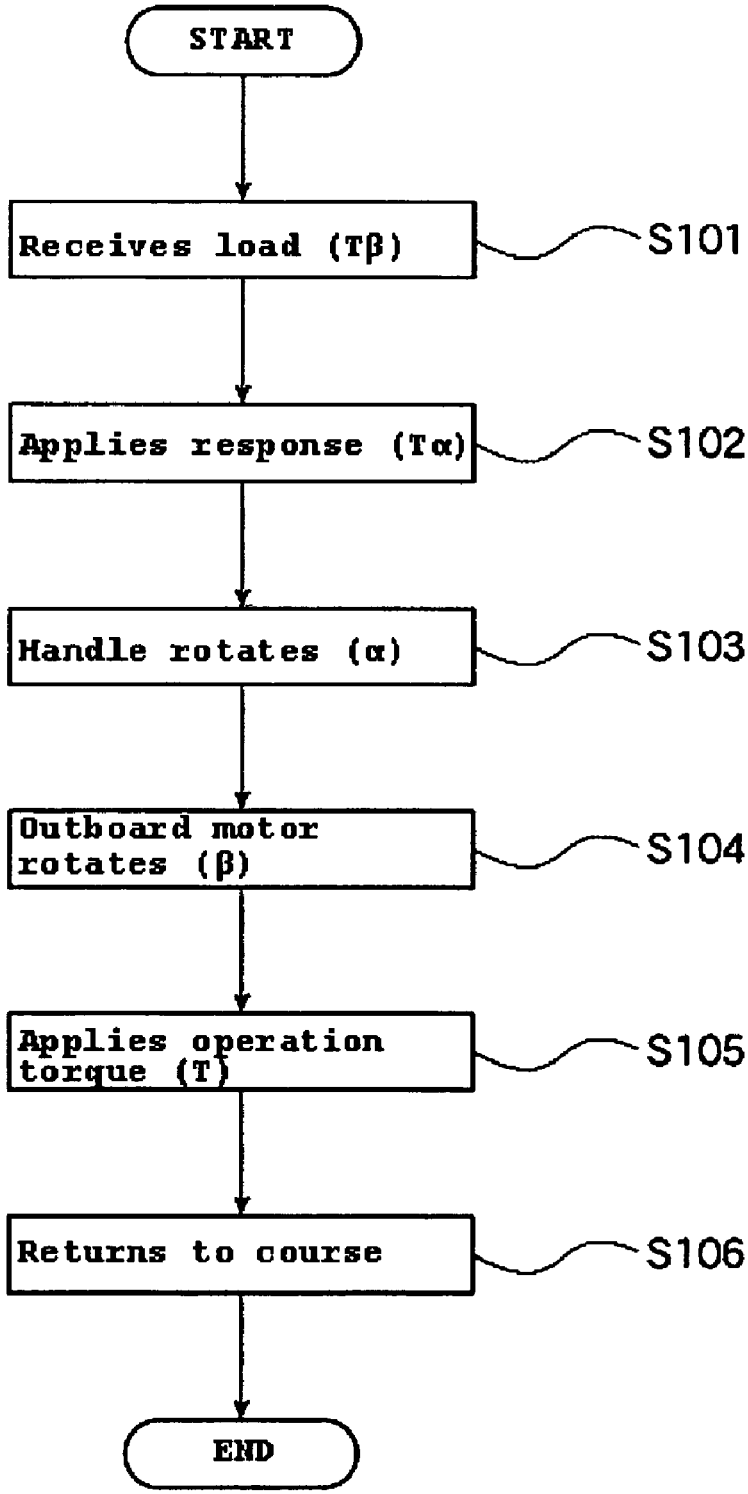
FIG. 4 is a flowchart, of additional processes that can be used for controlling a boat when the boat receives an external force.
Figure 5:
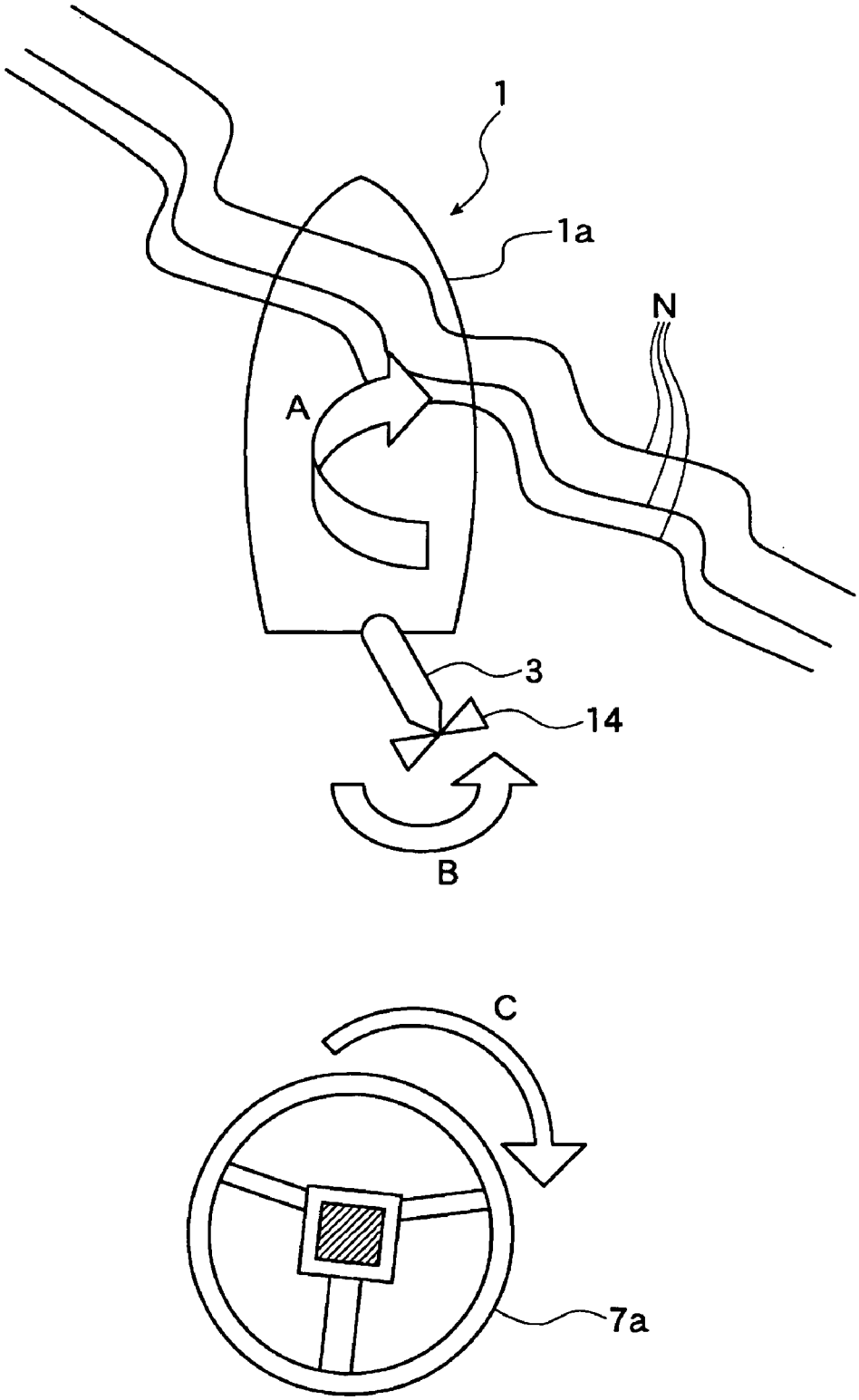
FIG. 5 is a schematic diagram illustrating force applied to a boat and a steering wheel.
Figure 7:
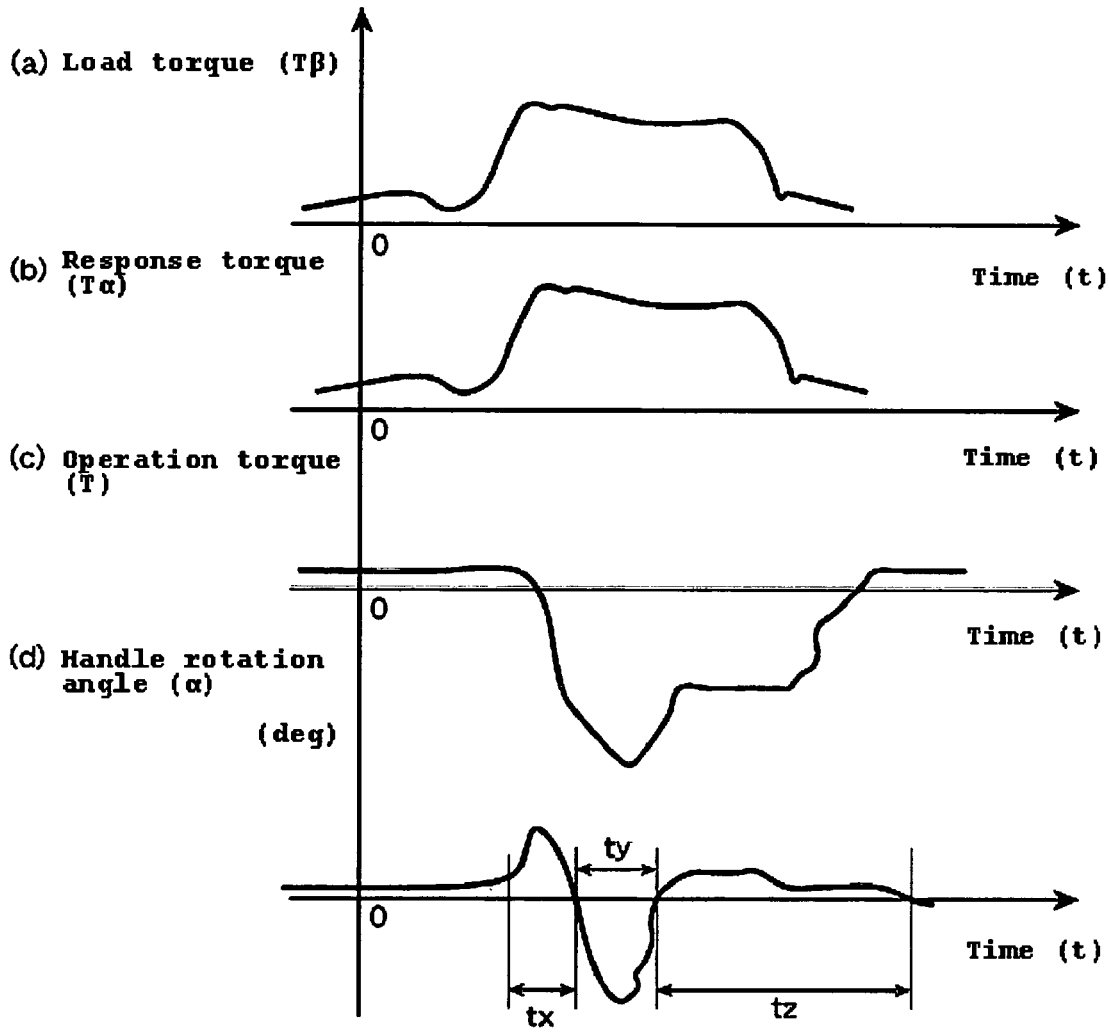
FIG. 7 includes several schematic timing diagrams showing relationships between the magnitude and the direction of external forces applied to a conventional steering control system for a boat.

FIG. 4 is a flowchart of exemplary operations that can be performed in some embodiments, when the boat 1 receives external force of a predetermined value or larger. FIG. 5 is a schematic diagram illustrating force applied to the boat 1 and the steering wheel 7*a* in some embodiments. FIG. 6 is a schematic diagram showing the magnitude and the direction of external force applied to the steering control system. 30 for the boat 1 according to some embodiments. FIG. 7 is a schematic diagram showing the magnitude and the direction of external force applied to a conventional steering control system for a boat.

Hereinafter, the control procedure in this embodiment is described based on FIGS. 4, 5, and 6, and using FIG. 7 for comparison.

As shown in FIG. 5, when the boat 1 is hit by a wave N coming from oblique forward direction (from the upper right side in the drawing) during navigation and the water-contacting areas on the left and right sides of the hull 1*a* become different from each other due to unevenness of the water surface, the hull 1*a* receives different water pressures between its left and right sides and turns to the side with a larger water pressure (the arrow A in FIG. 5). Then, the direction of the outboard motor 3 relative to the hull 1*a* changes, and load torque (the arrow B in FIG. 5) can be generated by changes in water pressures which act on the outboard motor 3 (S101 (FIG. 4)). The load torque Tβ generated at this time is shown in FIG. 6(*a*) for this embodiment, and in FIG. 7(*a*) for the conventional example.

The load sensor 16 provided in the boat 1 detects rotation torque and sends a signal to the control unit 12, which calculates load torque Tβ and target torque τ for the steering wheel 7*a* corresponding to the load torque Tβ. The control unit 12 drives the reaction torque motor 11 based on the value for the target torque τ and applies response torque Tα to the steering wheel 7*a* (S102 (FIG. 4)). The response torque Tα applied at this time is shown in FIG. 6(*b*) for this embodiment, and in FIG. 7(*b*) for the conventional example.

Driven by the reaction torque motor 11, the steering wheel 7*a* rotates in one direction (in the direction of the arrow C in FIG. 5) (S103 (FIG. 4)). The operation angle sensor 9 sends a detection signal for a rotation angle α of the steering wheel 7*a* to the control unit 12. The steering torque computing circuit 21 of the control unit 12 calculates the rotation angle α of the steering wheel 7*a* based on the signal supplied from the operation angle sensor 9, and rotates the outboard motor 3 by a rotation angle β corresponding to the rotation angle α in the corresponding direction (in the direction of the arrow B in FIG. 5) (S104 (FIG. 4)).

The operator senses the rotation of the steering wheel 7*a*, and applies operation torque T to the steering wheel 7*a* in the opposite direction of the response torque Tα (in the opposite direction of the arrow C in FIG. 5). The operation torque at this time is shown in FIG. 6(*c*) for this embodiment, and the operation torque T is shown in FIG. 7(*c*) for the conventional example. When the steering wheel 7*a* is applied with the operation torque T to rotate in the opposite direction (S105 (FIG. 4)), the outboard motor 3 rotates in the opposite direction (in the opposite direction of the arrow B in FIG. 5) and the boat 1 returns to its original navigation course (S106 (FIG. 4)).

With reference to FIGS. 6 and 7, a comparison is made between this embodiment and the conventional example. In the conventional example (FIG. 7), the steering wheel 7*a* is continuously applied with the response torque Tα, which can be dependent on values for the load torque Tβ (FIG. 7(*a*)). Meanwhile, in some of the present embodiments, the steering wheel 7*a* is applied with the pulsed response torque Tα (FIG. 6(*b*)) when the load variation amount ΔF by the external force F, which corresponds to the load torque Tβ, is larger than the reference value ΔF0 (FIG. 6(*a*)). Other differences are described below.

The magnitude of the response torque Tα applied to the steering wheel 7*a* in S102 (FIG. 4) can be smaller in this embodiment than in the conventional example. Thus, the rotation angle α of the steering wheel 7*a* (S103 (FIG. 4)) can be smaller in this embodiment than in the conventional example (FIG. 6(*d*) and FIG. 7(*d*)). This can reduce the power consumption of the reaction torque motor 11.

The rotation angle β of the outboard motor 3 (S104 (FIG. 4)) by the rotation of the steering wheel 7*a* is smaller in this embodiment than that in the conventional example. This can reduce the amount of deviation of the boat 1 from its original navigation course, thereby allowing it to easily return to the course.

To return the boat 1 to its original navigation course, the operator must apply to the steering wheel 7*a* approximately the same amount of operation torque T as that of the response torque Tα. Thus, in S105 (FIG. 4), while large, extended operation torque T, which can be generally the same as the load torque Tβ, can be applied to the steering wheel 7*a* in the conventional example (FIG. 7(*c*)), pulsed operation torque T which can be generally the same as the response torque Tα can only be applied to the steering wheel 7*a* in this embodiment (FIG. 6(*c*)). This can reduce the amount of energy to be applied as the operation torque T and the period for the application, thereby reducing the labor of the operator in operating the steering wheel 7*a*.

There can be a period tz during which the response torque Tα and the operation torque T are balanced in the conventional example (see FIG. 7(*d*)). However, there is no such period tz in some of the present embodiments (FIG. 6(*d*)), because the response torque Tα and the operation torque T are both applied as pulsed energy. That is, there is no long period during which the reaction torque motor 11 and the operator both apply torque to the steering wheel 7*a* for substantially no change in the navigation direction of the boat 1. This can prevent the loss of the labor of the operator and the power consumption of the reaction torque motor 11.

Also, the rotation angle α of the steering wheel 7*a* (S103) and the rotation angle β of the outboard motor 3 (S104 (FIG. 5)) are smaller in this embodiment than in the conventional example. As a result, the boat 1 less deviates from its navigation course and hence requires less time to return to its original navigation course (S106 (FIG. 5)) than in the conventional example. This can reduce the burden of operation on the operator and allows the boat 1 to more accurately follow its navigation course without meandering occasionally.

As described above, in some of the embodiments, the reaction motor 11 applies pulsed response torque Tα to the steering wheel 7*a*. Thus, the amount of operation torque T to be applied to the steering wheel 7*a* by the operator when external force changes can be reduced, and the labor and hence the fatigue of the operator during navigation can be reduced. Also, the driving amount and hence the power consumption of the reaction torque motor 11 can be reduced. In addition, there is no period during which the response torque Tα and the operation torque T both apply to the steering wheel 7*a* for no substantial change in the navigation direction of the boat 1, thereby allowing effective use of labor of the operator and power consumed by the reaction torque motor 11.

In some of the embodiments, the reaction torque to be applied to the steering wheel 7*a* can be computed in consideration of boat velocity data. For example, the magnitude of reaction torque may be made inversely proportional to the boat velocity, resulting in smaller reaction torque for higher velocity. In this way, reaction torque suitable for the running velocity can be applied to the boat 1, thereby improving the riding comfort and the security in steering the boat 1.

The boat 1 is a small boat in the illustrated embodiments. However, inventions disclosed herein can be used with medium or large-sized boats.

In some of the present embodiments, the reference value ΔF0 and the target torque τ used to generate the response torque Tα are calculated using the load torque Tβ, the running state, and the navigation velocity. However, they may be calculated using other conditions. Also, in some embodiments, the engine speed can be used as the running state. However, any other values which indicate the running state may be used instead. For example, the engine temperature or the cooling water temperature, or the remaining amount of fuel or oil may be used.

In some embodiments, the target torque τ and the response torque Tα are formed as pulses of triangular or saw-tooth waves. However, they may be formed as pulses of any shape, such as of rectangular waves or sine waves.

In some embodiments, the reaction torque computing circuit 17 acquires information on external force, running state, and velocity through the sequence of the external force acquisition process (S1), the running state acquisition process (S2), and the velocity-acquisition process (S3), as shown in FIG. 3. However, the present inventions are not limited thereto. That is, such information may be acquired through the external force acquisition process (S1), the running state acquisition process (S2), and the velocity acquisition process (S3) performed in a different sequence, in order to derive the reference value ΔF0.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering control system for a boat provided externally of its hull with a steering device rotatable by an electric actuator to change a navigation direction, comprising:

a steering system electrically connected to the steering device via the electric actuator to operate the steering device;

external force detection means for detecting external force applied to the steering device;

a reaction torque motor for applying torque to the steering system; and control means which monitors a detection state of the external force detection means, and causes the reaction torque motor to apply pulsed torque when the external force detection means detects that an amount of variation in the external force is a predetermined value or larger.

2. The steering control system for a boat according to claim 1, wherein the control means determines a magnitude and a duration of the torque applied by the reaction torque motor based on a magnitude of the external force detected by the external force detection means.

3. The steering control system for a boat according to claim 1, further comprising velocity detection means for detecting a navigation velocity of the boat, and running state detection means for detecting a running state of the boat, wherein the control means additionally monitors detection states of the velocity detection means and the running state detection means, and determines a magnitude and a duration of the torque applied by the reaction torque motor based on the detected navigation velocity and running state, in addition to the external force.

4. The steering control system for a boat according to claim 2, further comprising velocity detection means for detecting a navigation velocity of the boat, and running state detection means for detecting a running state of the boat, wherein the control means additionally monitors detection states of the velocity detection means and the running state detection means, and determines a magnitude and a duration of the torque applied by the reaction torque motor based on the detected navigation velocity and running state, in addition to the external force.

5. The steering control system for a boat according to claim 1, wherein the control means causes the reaction torque motor to apply torque when the amount of variation in the external force is larger than a reference value calculated from the external force, the velocity, and the running state.

6. The steering control system for a boat according to claim 2, wherein the control means causes the reaction torque motor to apply torque when the amount of variation in the external force is larger than a reference value calculated from the external force, the velocity, and the running state.

7. The steering control system for a boat according to claim 3, wherein the control means causes the reaction torque motor to apply torque when the amount of variation in the external force is larger than a reference value calculated from the external force, the velocity, and the running state.

8. The steering control system for a boat according to claim 4, wherein the control means causes the reaction torque motor to apply torque when the amount of variation in the external force is larger than a reference value calculated from the external force, the velocity, and the running state.

9. A steering control system for a boat having a steering input device disposed in an operator's area and a steering device arranged to contact a body of water in which the boat operates to generate forces for turning the boat, the control system comprising an electric actuator configured to move the steering device through a range of movement corresponding to different moving directions of the boat, an external force detector configured to detect an external force applied to the steering device, a reaction torque motor configured to apply a torque to the steering input device, and a controller configured to monitor a detection state of the external force detector, and to control the reaction torque motor to apply pulsed torque to the steering input deice when the external force detector detects an amount of variation in the external force is a predetermined value or larger.

10. The steering control system for a boat according to claim 9, wherein the controller is configured to determine a magnitude and a duration of the torque applied by the reaction torque motor based on a magnitude of the external force detected by the external force detector.

11. The steering control system for a boat according to claim 9, further comprising a velocity detector configured to detect a velocity of the boat, and a running state detector configured to detect a running state of the boat, wherein the controller is additionally configured to monitor the velocity detector and the running state detector, and to determine a magnitude and a duration of the torque applied by the reaction torque motor based on the detected navigation velocity and running state, in addition to the external force.

12. The steering control system for a boat according to claim 10, further comprising a velocity detector configured to detect a velocity of the boat, and a running state detector configured to detect a running state of the boat, wherein the controller is additionally configured to monitor the velocity detector and the running state detector, and to determine a magnitude and a duration of the torque applied by the reaction torque motor based on the detected navigation velocity and running state, in addition to the external force.

13. The steering control system for a boat according to claim 9, wherein the controller is configured to cause the reaction torque motor to apply torque when the amount of variation in the external force is larger than a reference value calculated from the external force, the velocity, and the running state.

* * * * *

UNITED STATES PATENT AND TRADEMARK OFFICE

CERTIFICATE OF CORRECTION

PATENT NO. : 7,267,069 B2
APPLICATION NO. : 11/384616
DATED : September 11, 2007
INVENTOR(S) : Mizutani et al.

It is certified that error appears in the above-identified patent and that said Letters Patent is hereby corrected as shown below:

At page 2, column 2 (Foreign Patent Documents), line 2, please delete "A-204-155282" and insert -- A-2004-155282 --, therefor.

At column 2 (Other Publications), line 24, please delete "Invenor:" and insert -- Inventor: --, therefor.

At column 2 (Other Publications), line 27, please delete "Muzutani." and insert -- Mizutani. --, therefor.

At column 2 (Other Publications), line 33, please delete "Sterring" and insert -- Steering --, therefor.

At column 2 (Other Publications), line 35, please delete "US2006-0079139A1." and insert -- US2007-0049139A1. --, therefor.

At column 2, line 59, please delete "flowchart," and insert -- flowchart --, therefor.

At column 7, line 20, please delete "system." and insert -- system --, therefor.

Signed and Sealed this

Eleventh Day of November, 2008

JON W. DUDAS
*Director of the United States Patent and Trademark Office*